United States Patent [19]

Saunders et al.

[11] 4,069,991

[45] Jan. 24, 1978

[54] CHOCK FOR ROCK CLIMBING

[75] Inventors: Thomas C. Saunders; James R. Clark, both of Kirkland, Wash.

[73] Assignee: Seattle Manufacturing Corporation, Bellevue, Wash.

[21] Appl. No.: 749,074

[22] Filed: Dec. 9, 1976

[51] Int. Cl.[2] ..... A47G 29/00

[52] U.S. Cl. ..... 248/1; 248/317

[58] Field of Search ..... 248/1, 216, 317; 9/46; 294/74, 78

[56] References Cited

U.S. PATENT DOCUMENTS

| | | | |
|---|---|---|---|
| 3,946,975 | 3/1976 | Lyman | 248/1 |
| 3,957,237 | 5/1976 | Campbell | 248/1 |

OTHER PUBLICATIONS

Summit, W. Feverer, 3-1960.

"Hardware", G. Lowe, 1-1972.

*Primary Examiner*—Robert A. Hafer

*Attorney, Agent, or Firm*—Seed, Berry, Vernon & Baynham

[57] ABSTRACT

A chock for rock climbers to be used with a loop sling threaded through openings in the chock body which comprises a length of extruded aluminum having beveled ends and a generally triangular cross-section. One of the faces of the chock is arched outwardly and longitudinally toothed. This is located opposite a nose portion which bears against one rock face of a crack while the arched face operates against the opposite face of the crack.

12 Claims, 10 Drawing Figures

CHOCK FOR ROCK CLIMBING

BACKGROUND OF THE INVENTION

1. Field of the Invention

The present invention relates to an improved chock for use with a loop sling by rock climbers.

2. Description of the Prior Art

The rapid increase in the number of rock climbers has focused attention upon the necessity of employing climbing methods which are not destructive to the climbing area. This has resulted in a change from the use of pitons whose placement and removal erode the rock, to the use of lightweight chocks, also often referred to as chockstones or nuts, which are adapted to be jammed into existing cracks in rock and are designed to be removed by pulling on the related sling away from the wedging direction.

In general, two types of slings are used. One comprises a loop of rope or webbing threaded through the chock and made endless by a knot to receive a carabiner and hence will be referred to herein as a "loop" sling. The other type, normally made from wire rope, comprises a single run of cable secured at an end to the chock as by having a swagged head socketed in the chock, and having its other end doubled back and secured by a suitable crimped fitting to form a terminal eye for receiving a carabiner. This type is commonly referred to as a "single cable" sling.

The idea of jamming objects into cracks is an old concept in mountaineering. The English discovered that machine nuts through which a loop sling was threaded could offer better protection than knots or stones, and this was the forerunner of the more sophisticated "nuts" used as chocks today.

To reduce the number of chocks required to be carried by a climber to provide for the various widths of cracks which might be encountered, "camming" chocks have come into use, and namely chocks which wedge by rotation, and hence, can function for a range of crack widths. A simple example is the T-shaped "Titon" marketed by Forrest Manufacturing, Ltd., Denver, Colo., in which the center stem (leg) of the tee is slotted to receive the sling and the two flange arms of the tee act, one as a fulcrum on one face of a crack, and the other as a rotating wedge against the opposite face responsive to a load exerted on the center stem via the sling. A more complicated example, is "Kirk's Kamms", marketed by Colorado Mountain Industries Corporation, Cincinnati, Ohio, which have a single cable sling permanently anchored in the chock and riding from its anchor point in an exposed groove along a straight wedge face which comprises part of the peripheral edge. The remainder of the edge is curved to provide a rolling edge varying in distance from the anchored end of the sling.

Another commonly used chock is the "Hexentric" marketed by the Great Pacific Iron Works, Ventura, Calif., which comprises a short length, beveled at its ends, of extruded aluminum stock having a hexagonal cross-section with all of its sides of different widths. Two of the sides of the hexagon are substantially parallel and have pairs of registering holes through which a loop sling is threaded such that the bight of the loop bears against the wider of the two sides when the loop is tensioned. A Hexcentric" is essentially a wedge, but will "cam" to a limited extent in parallel walled cracks. Because of its beveled end faces, a "Hexcentric" can be placed lengthwise as a wedge across a constricting section of a crack.

A more complicated camming chock than those described above is the "L.A.S. Split Cam Nut" marketed by Lowe Alpine Systems, Boulder, Colo., which includes a pair of parallel spaced, constant angle, toothed cam plates interconnected by a bolt carrying two orientation bars each with an eye at its free end for directly receiving a carabiner or a runner. When a force is applied to the orientation bar the cam teeth are pressed against the crack wall.

SUMMARY OF THE INVENTION

Each of the aforedescribed chocks has advantages and disadvantages. A study of these indicates that a superior chock should satisfy at least the following objectives:

1. Be adapted to be used with a flexible loop sling;
2. Have a relatively wide camming range so that a few chocks of various sizes can cover a wide range of crack widths;
3. Have increased camming leverage as the chock rotates into holding position;
4. Be relatively easy to remove after use;
5. Only require one orientation to effectively locate the chock in a crack;
6. Be able to be placed lengthwise as a wedge in a crack;
7. Have excellent rock gripping capability;
8. Have both a wedging mode and a camming mode;
9. Be light in weight, and yet strong;
10. Be of simple construction (no gadgetry) and inexpensive to produce;
11. Be capable of being used in a slotted mode;
12. Not subject the sling to rubbing action on the rock adjacent the chock; and
13. Not be restricted in use in narrow cracks by interference with the sling.

Accordingly, the present invention aims to provide an improved chock meeting all of these objectives. This is accomplished by using a piece of extruding aluminum tubular stock having a generally triangular cross-section with unequal sides, one of which is arched and serrated. The other two sides meet at a rounded nose opposite the arched side, and for passage of a loop sling the narrower of these two sides is formed with a pair of holes while the remaining side is planar and laterally slotted through most of its width. The slotting carries into the arched side so that the sling will not prevent the planar side from serving as a wedge face.

DETAILED DESCRIPTION OF THE PREFERRED EMBODIMENTS

Figure 4:
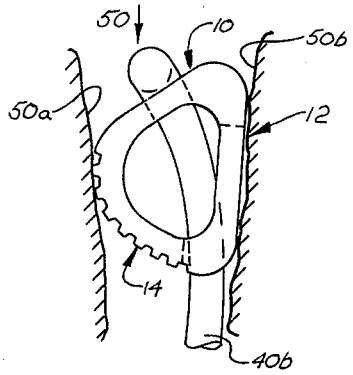
FIG. 4 is a side elevational view showing the chock in wedging position.

Referring to the drawings, it is seen that the chock of the present invention is tubular and of generally triangular cross-section providing three side faces 10, 12 and 14 extending longitudinally between a pair of end faces 16, 18. The first and second side faces 10, 12 diverge at an acute angle of about 55° from a rounded longitudinal nose portion 20. These faces 10, 12 may be planar as illustrated, whereas the third side face 14 arches oppositely from the nose portion 20 and is preferably serrated to provide longitudinal teeth 21.

Figure 2:
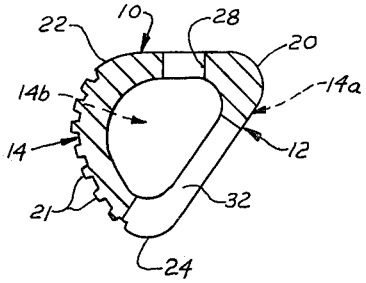
FIG. 2 is a transverse sectional view of the chock taken as indicated by the line 2—2 in FIG. 1.

The radius of curvature of the face 14 is not critical, but the center of curvature of most of the face may be located at the juncture of the second face 12 and the nose portion 20 as indicated by the phantom arrow 14*a* in FIG. 2. Near its transverse edges the curvature of the face 14 is modified to smoothly blend by rounded juncture portions 22, 24 with the side faces 10 and 12, respectively. The center of curvature of portion 22 is indicated by the phantom arrow 14*b* in FIG. 2.

It will be noted that the first face 10 is about one-third narrower than the second face 12 and is formed with a pair of longitudinally spaced round openings 26, 28 separated by a bridge portion 29 for engagement by the bight 40*a* of a sling 40 threaded through the openings. These openings 26, 28 are complemented by a pair of slots 30, 32 in the second face 12 which extend transversely a major part of the width of the face 12 and also extend through the rounded juncture 24 between the face 12 and the arched third face 14 sufficiently that the runs 40*b*, 40*c* of the sling 40 can occupy a position within the confines of face 12 as shown in FIG. 4. In this regard, is is preferred that the face 12 be planar to serve in some instances as a wedge face. This is not true of the face 10 and hence, although this face is shown as planar, that detail is not functionally significant. For purposes of example, as indicated in FIG. 9, the loop sling 40 may comprise a length of rope made endless by a suitable knot 42 after being threaded through the pairs of openings 26, 28 and slots 30, 32.

Figure 9:
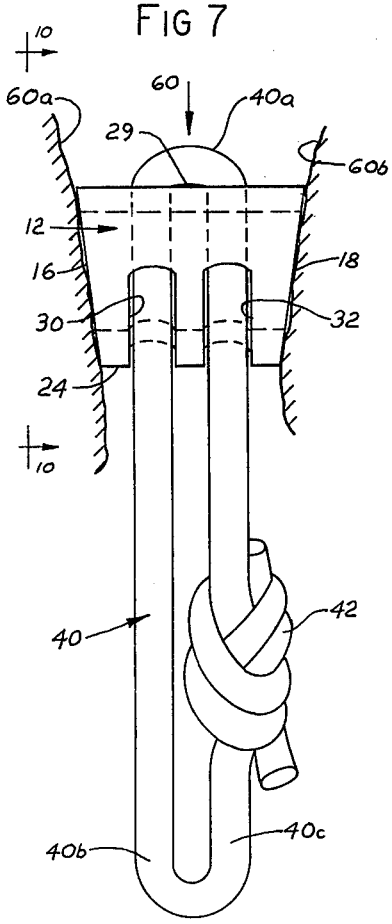
FIG. 9 is a front elevational view looking into the mouth of a tapered crack and with the chock in a wedging mode using its beveled end faces as wedging faces.
Figure 3:
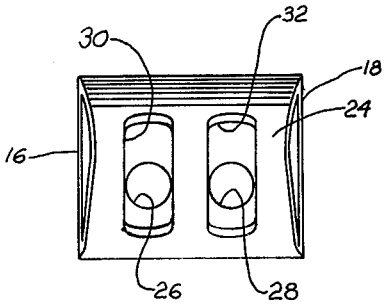
FIG. 3 is a bottom view of the chock.

As shown in FIGS. 3 and 9, the end faces 16, 18 are beveled inwardly from the ends of the side face 10 in like manner so that preferably the minimum width of the chock is found along the rounded juncture 24 and the maximum width is located along the face 10. About an 80° bevel angle between the plane of the side face 10 and the planes of the end faces 16, 18 is satisfactory. FIG. 4 illustrates the chock in operative position in a relatively narrow crack 50 having one of its side walls 50*a* with a generally planar portion at a location whereat the width of the crack is less than the maximum distance from the face 12 to the curved face 14. In such a circumstance the faces 12, 14 both function as wedge faces. As previously indicated, because the slots 30, 32 extend into the juncture portion 24 the sling can hang free of the chock without being wedged between the chock and the crack walls.

Figure 5:
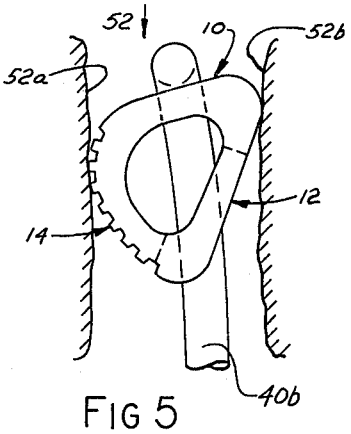
FIGS. 5 and 6 are side elevational views illustrating the chock in camming positions in different crank widths.
Figure 6:
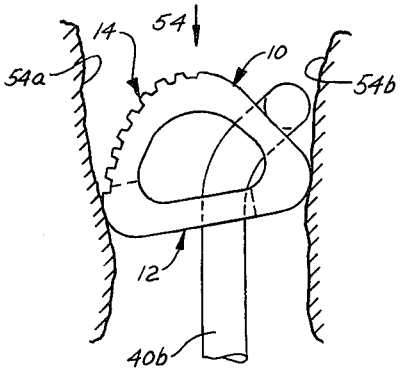

FIGS. 5 and 6 show "camming" of the chock in relatively narrow and wide cracks 52 and 54, respectively. Directing attention first to FIG. 5, it is seen that the chock nose 20 is forced by the line of pull on the sling 40 to swing against the rock wall 52*b* as the chock rocks downwardly on the teeth 21 over the rock wall 52*a*. In this regard, it will be noted that the holes 26, 28 in the chock are closer to the nose 20 than the arched side 14 of the chock to give the proper leverage.

Continuing to FIG. 6 wherein the crack 54 is wider, it will be noted that although the chock is rotated further clockwise to bring the nose 20 against the right wall 54*b*, the contact with the left wall 54*a* has about the same orientation relative to the level of the nose 20 as in the case of the narrower crack 52. Significantly, the lever arm from the line of pull of the sling to the area of contact with the left crack face increased in the wider crack condition, thereby insuring that the chock will be maintained in a tightly jammed position.

Figure 7:
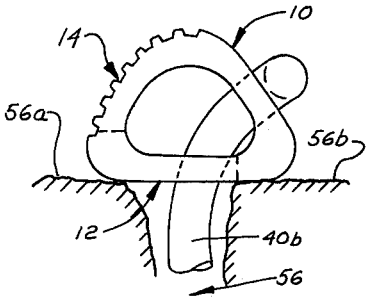
FIG. 7 shows the chock used in a slotting condition.
Figure 8:
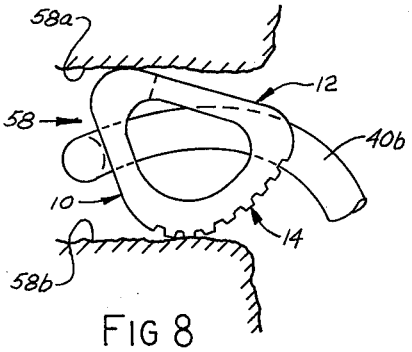
FIG. 8 illustrates the chock as used in a generally horizontal crack.

FIG. 7 shows the chock in use in what is known as a "slotted" condition, and namely one in which a vertical crack or slot 56 opens downwardly from overhanding ledge faces 56*a*, 56*b*. In that instance the planar face 12 is seated on the ledge faces with the sling hanging down through the crack 56. In FIG. 8 the chock is illustrated as jammed by a camming action in a generally horizontal crack 58 with the serrated face 14 bearing against the lower wall 58*b* of the crack and the nose 20 forced against the upper wall 58*a* by the tension on the sling which not only pulls on the bridge 29 but may bear against the end of the slots 30, 32 in the rounded portion 24 of the chock body.

Figure 10:
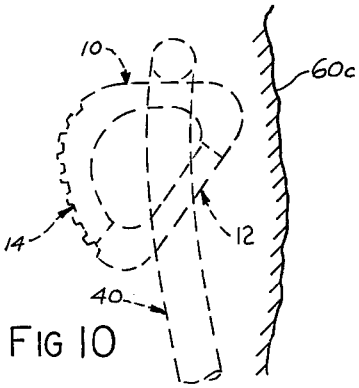
FIG. 10 is a side view taken vertically through the rock to the left of the chock as indicated by line 10—10 in FIG. 9.
Figure 1:
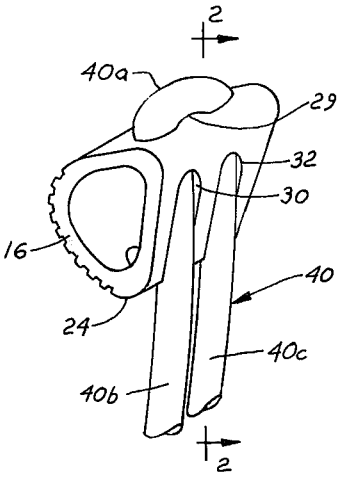
FIG. 1 is a perspective view of a chock embodying the present invention and shown equipped with a loop sling.

The use of the beveled end faces 16, 18 of the chock as wedge faces in a wider downwardly tapering crack 60 having sloped walls 60*a*, 60*b* is shown in FIGS. 9–10. It will be noted that the pull of the sling may be straight down on the bridge 29 between the holes 26, 28 in the shorter wall 10. Although the inward bevel of the end faces 16, 18 is shown as commencing at the face 10, as an alternative it can commence at the nose portion 20.

The chock may be cut with its bevel ends from a length of extruded heat treated aluminum having a tubular shape providing the illustrated cross-section of the walls 10,12 and 14 with the teeth 21. Then the chock is completed by machining the holes 26, 28 and slots 30, 32.

The chock of the present invention is preferably made in sets providing a range of sizes so that a climber is equipped for various crack widths. In small sizes for strength purposes the aluminum extrusion is solid rather than tubular, thereby eliminating the center longitudinal hole. The arrangement of slots 30, 32 relative to the holes 26, 28 and remainder of the structure permits the sling 40 to be moved under load from side to side of a crack in which the chock is lodged in the manner illustrated in FIGS. 4–8, without danger of such movement dislodging the chock. Yet, when it is desired to remove the chock from a crack, such can usually be accomplished by jerking the chock upwardly and outwardly by pulling on the free end portion of the sling. In some instances it may be necessary to pull on the bight 40*a*.

The embodiments of the invention in which a particular property or privilege is claimed are defined as follows:

1. A chock for use with a loop sling in rock climbing comprising:

a body having end faces and having side faces and a nose each extending between the end faces, one of said side faces being a convex curved face located opposite said nose for engaging one rock face of a crack with the nose contacting the opposite rock face of the crack, said convex curved face having side borders at the opposite sides thereof which extend between said end faces, one of said side borders of the convex face being spaced further from said nose than the other said side border thereof so that the distance from the rock engaging portion of the convex face to the nose is variable by rocking the body on its convex face to wedge the nose against said opposite rock face, and a pair of sling passage means in said body separated by a bridge located closer to said nose than said convex face for receiving the bight of a loop sling whereby a load on the sling pulls on said bridge and forces said nose against said opposite rock face with said convex face engaging said one rock face.

2. A chock according to claim 1, in which said pair of sling passage means are located with the plane of said bight extending between said end faces.

3. A chock according to claim 1 in which said convex face has elongated teeth with their length extending between said end faces.

4. A chock according to claim 1 in which another of said side faces extends between said nose and the side border of said convex face which is the closer to said nose, said pair of sling passage means including a pair of holes through said another side face and separated by said bridge.

5. A chock according to claim 4, in which a third one of said side faces extends between said nose and the other longitudinal edge of said convex face and merges with the latter at a rounded juncture portion, said pair of sling passage means also including a pair of slots registering with said pair of holes and extending through said juncture portion and a major part of the width of said third side face whereby a direct pull on said bridge by the sling can be established for a range of orientations of said convex face and nose.

6. A chock according to claim 4 in which said end faces are beveled to converge away from said another side face to serve as wedge faces when the chock body is placed in a crank with its end faces engaging the opposite rock faces of the crank.

7. A chock according to claim 5, in which said third side face is planar to serve as a wedge face in a crack narrower than the minimum distance from said nose to said convex face.

8. A chock for use with a loop sling in rock climbing comprising:

a body having two opposite end faces and having first, second and third side faces and a nose each having side borders extending between said end faces, the first and third side faces having respective of their side borders common with the side borders of said nose and having their other side borders in common with the side borders of the second side face, said second side face being convexly curved between its side borders and being located opposite said nose for engaging one rock face of a crack with the nose contacting the opposite rock face of the crack, the side border common to the second and third side faces being spaced further from said nose than the side border common to the first and second side faces so that the distance from the rock engaging portion of the convex second side face to said nose is variable by rocking the body on its second side face to wedge said nose against said opposite rock face, and a pair of sling passages through said body between said end faces and separated by a bridge, said sling passages extending from said first side face to a respective pair of slots which extend across a major part of the width of said third face and into a portion of the width of the second side face whereby a direct pull on the bridge by the sling can be established for a range of orientations of said second face and nose.

9. A chock according to claim 8 in which said third side face is planar to serve as a wedge face in a crack narrower than the minimum distance from said nose to said second face, and in which said slots extend far enough into said second face to permit the sling to be out of engagement with the side wall of the crack engaged by said third side face when the latter is serving as a wedge face.

10. A chock according to claim 8 in which a rounded side border portion joins the second and third side faces and has said slots extending thereacross.

11. A chock according to claim 8 in which said second face is serrated and said nose and first and third faces are relatively smooth.

12. A chock according to claim 8 in which said body is tubular with open ends at said end faces.

* * * * *